US005092473A

United States Patent [19]

Zelniker

[11] Patent Number: 5,092,473

[45] Date of Patent: Mar. 3, 1992

[54] HANG RAIL

[75] Inventor: Arthur Zelniker, Hicksville, N.Y.

[73] Assignee: Econoco Corporation, Hicksville, N.Y.

[21] Appl. No.: 701,192

[22] Filed: May 16, 1991

[51] Int. Cl.[5] ..... A47F 5/00

[52] U.S. Cl. ..... 211/124; 211/7

[58] Field of Search ..... 211/124, 7, 8; 70/59, 70/62

[56] References Cited

U.S. PATENT DOCUMENTS

| | | | |
|---|---|---|---|
| 3,419,154 | 12/1968 | Shapiro et al. | 211/124 X |
| 3,472,385 | 10/1969 | Shapriro et al. | 211/124 X |
| 3,581,905 | 6/1971 | Shapiro et al. | 211/7 |
| 3,610,423 | 10/1971 | Parillo | 211/7 |
| 4,037,728 | 7/1977 | Cameron | 211/124 |
| 4,079,840 | 3/1978 | Usner | 211/124 |
| 4,753,355 | 6/1988 | Hall et al. | 211/124 X |
| 4,887,727 | 12/1989 | Simmerman et al. | 211/124 |

FOREIGN PATENT DOCUMENTS

| | | | |
|---|---|---|---|
| 2044094 | 10/1980 | United Kingdom | 211/124 |

*Primary Examiner*—Robert W. Gibson, Jr.
*Attorney, Agent, or Firm*—Jordan B. Bierman

[57] ABSTRACT

A hanger retaining device including a generally cylindrical hanger bar for receiving clothes hangers and retaining pins substantially perpendicular to the axis of the bar, substantially parallel to each other, and mounted on the bar. A retaining rod slidably mounted on the retaining pins for movement into a closed position wherein the hangers are held or into an open position wherein the hangers may be removed from said bar. A pressure member urging the rod toward its open position is on the retaining pins, and a notch is provided thereon. A slider is mounted on the bar for movement parallel to the axis thereof and has an opening through which the retaining pins pass; there is a retaining edge on the opening which is urged toward the notch, whereby movement of said slider away from the notch withdraws the edge from the notch and permits the rod to move to the open position. Movement of the rod to its closed position permits the edge to enter the notch and hold the rod in its closed position.

20 Claims, 2 Drawing Sheets

HANG RAIL

This invention is directed to an improvement in store fixtures, more particularly to a hanger retaining device which is intended to permit the transportation and storage of hangers while they remain on the support bar without any risk that one or more will fall off.

BACKGROUND OF THE INVENTION

When a shipment of clothing is received by a retailer, the garments are removed and hung on the retailers' own hangers. When the garments are sold to the consumer, the empty hangers are often casually dropped into cartons for future use. In cartons the hangers become entangled; the time and effort required to separate them may render their reuse uneconomic. The present invention is a simple device which will permit the hangers to be placed thereon and will retain them even when the device is moved or jostled. The hangers can then be stored in an orderly fashion for easy reuse.

BRIEF DESCRIPTION OF THE PRESENT INVENTION

The hanger retaining device of the present invention is made up of a generally cylindrical hanger bar which is adapted to receive clothing hangers thereon in the usual manner. Retaining pins, parallel to each other, are mounted on the hanger bar substantially perpendicular to its axis. A retaining rod is slidably mounted on the retaining pins and can move into a closed position adjacent the bar or an open position remote therefrom. One or more compression springs are provided on the remaining pins urging the rod away from the bar towards its open position.

There is a notch on at least one of the retaining pins and corresponding slider is mounted on the bar for movement parallel to the axis. There is an opening in the slider through which the retaining pin passes and an edge of that opening is urged in a locking direction toward the notch. When the edge is within the notch, it locks the rod in its closed position.

Thus, movement of the slider in a direction opposite to the locking direction will withdraw the edge from the notch. When this happens, the pressure member causes the rod to move from its closed position to its remote open position, wherein hangers may be added or removed.

When locking is desired, the rod is moved toward the bar against the resistance of the pressure member. When the closed position is reached, the slider moves so that the edge of the hole moves toward the notch, engaging it, and locking the rod in its closed position.

The operation of the device is extremely simple. Starting from the open position, as many hangers as are desired are placed on the bar. The rod is then manually pushed toward the bar until it reaches its closed position. The edges of the holes in the sliders are automatically urged into the notch and the entire asembly is secured thereby. The hangers cannot shake loose, but are fixed on the bar.

When release is desired, it is only necessary to move the sliders so that the edges are disengaged from the notch. The bias of the pressure member will then force the rod away from the bar into its open position.

In a preferred form of the device, there are two retaining pins one adjacent each end. Similarly, there are two sliders, one for each pin. The notches face the mid point of the bar and the sliders are biased outwardly along its axis.

To release, the outer ends of the sliders are pressed inwardly against the bias and the edge of the hole moves out of contact with the notch. The rod then springs away from the bar under the influence of the pressure members.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
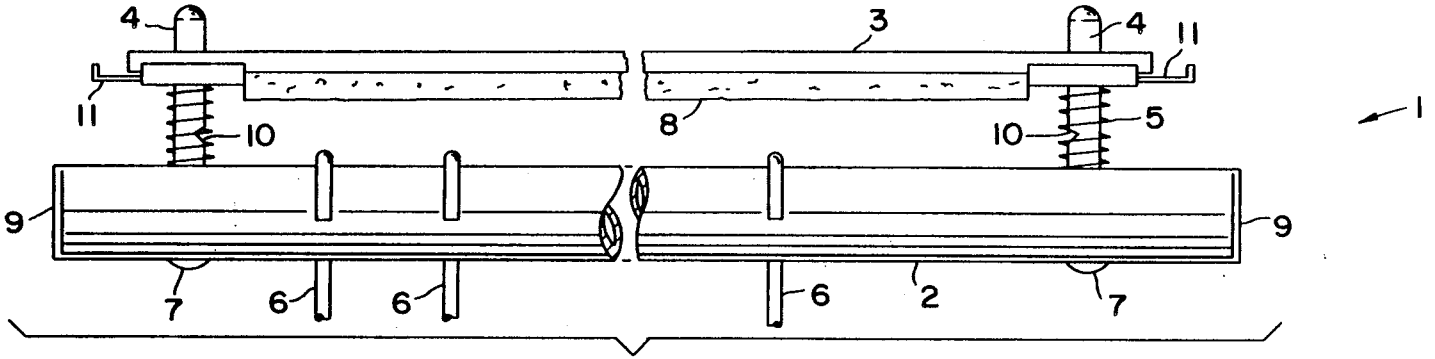
FIG. 1 is an elevation of the device of the present invention.

Referring first to FIG. 1, hang rail 1 comprises hanger bar 2 and retaining rod 3. Rod 3 is slidably mounted on retaining pins 4 and is urged away from bar 2 by separating springs 5. Hanger hookd 6 (shown with the hangers themselves broken away) are suspended on bar 2 and heads 7 prevent pins 4 from being pulled through bar 2. Caps 9 finish off the bar and provide a pleasing appearance.

Figure 2:
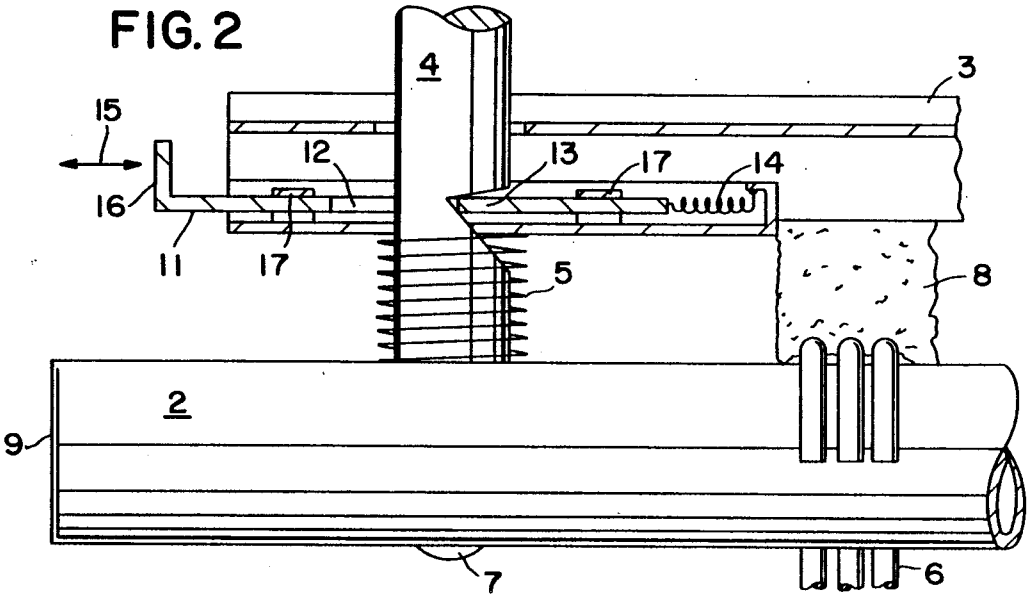
FIG. 2 is an enlarged view, partly in section showing the latching mechanism.

The latching mechanism is best shown in FIG. 2. Slider 11 comprises slider opening 12 having edge 13, slider spring 14, and release 16. Slider 11 can move in the directions shown by arrows 15 and is retained in position by slider guides 17.

To release rod 3, release 16 is pressed against the pressure of slider spring 14 to the right as shown in FIG. 2. Edge 13 moves to a position outside of notch 10 and separating spring 5 forces rod 3 upwardly and away from bar 2. When this happens, sponge 8 is no longer in contact with hangers 6 so that they can be removed or others added. Guides 17 retain slider 11 in position and permit it to slide as is required.

On closing, rod 32 is pressed downwardly as shown in FIG. 2 until edge 13 reaches the level of notch 10. At this point, the bias of slider spring 14 urges it into notch 10, thereby locking rod 3 against bar 2.

Figure 4:
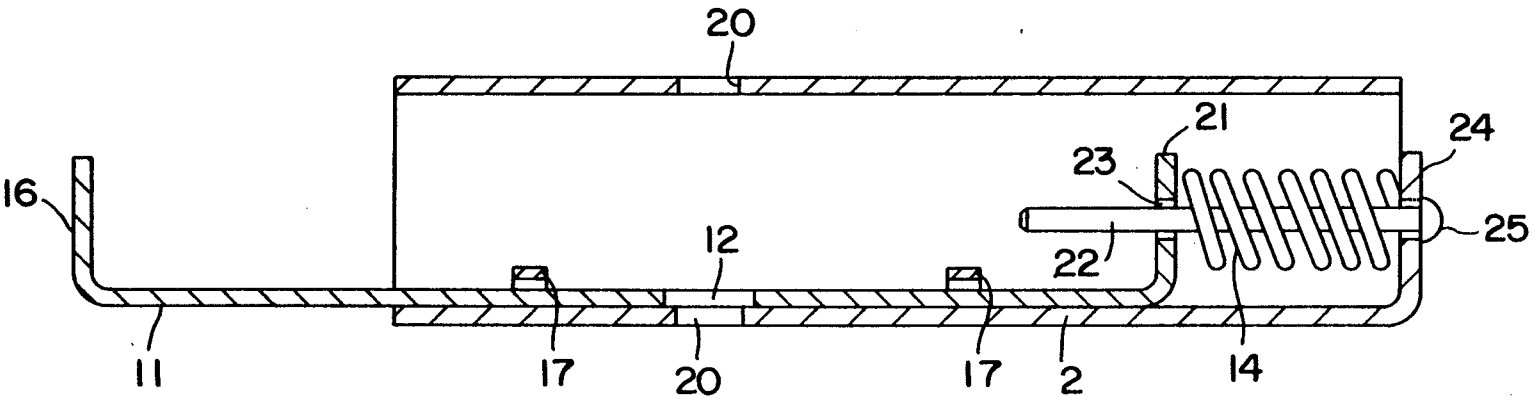
FIG. 4 is an enlarged view similar to that of FIG. 2 of another embodiment of the invention.

Another embodiment of the invention is shown in FIG. 4. For clarity, some parts have been omitted. Bar 2 is provided with holes 20 for the retaining pins (not shown). The end of slider 11 remote from release 16 is provided with upstanding spring guide 21 having guide hole 23 therethrough. Guide pin 22 extends axially of slider spring 14 and is secured to an end of bar 2 by head 25. In this form of the device, the spring is steadied and maintained in position by guide pin 22.

Figure 3:
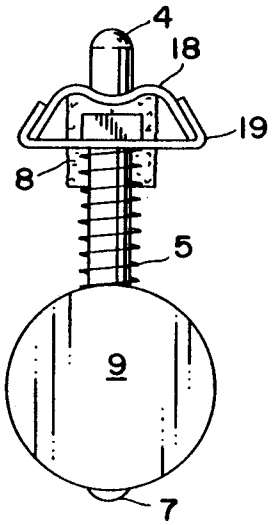
FIG. 3 is an end view of the device.

In FIG. 3, rod 3 advantageously comprises inverted channel 18 containing sponge 8 within its arms. Clamp portion 19 is secured adjacent the ends thereof. This provides an inexpensive but sufficiently rigid construction.

While only a limited number of specific embodiments of the invention have been expressly described, it is, nonetheless, to be broadly construed and not to be limited except by the character of the claims appended hereto.

I claim:

1. A hanger retaining device comprising a generally cylindrical hanger bar for receiving hangers thereon and having an axis therethrough, retaining pins substantially perpendicular to said axis, substantially parallel to each other, and mounted on said bar;

a retaining rod slidably mounted on said retaining pins for movement into a closed position wherein said hangers are held between said bar and said rod or an open position wherein said hangers may be removed from said bar, a pressure member urging said rod toward said open position on at least one of said retaining pins, a notch in at least one of said retaining pins, slider mounted on said bar for movement parallel to said axis, an opening in said slider through which said one of said retaining pins passes, said opening having a retaining edge which is urged in a locking direction toward said notch by a slider spring, whereby movement of said slider opposite to said locking direction withdraws said edge from said notch and permits said rod to move to said open position and movement of said rod to said closed position permits said edge to enter said notch and hold said rod in said closed position.

2. A hanger retaining device comprising a generally cylindrical hanger bar for receiving hangers thereon and having an axis therethrough, two retaining pins substantially perpendicular to said axis, substantially parallel to each other, and mounted on said bar;

a retaining rod slidably mounted on said retaining pins for movement into a closed position adjacent said bar and wherein said hangers are held between said bar and said rod or into an open position remote from said bar wherein said hangers may be removed from said bar, a pressure member urging said rod toward said open position on at least one of said retaining pins, a notch in at least one of said retaining pins, two sliders mounted on said bar for movement parallel to said axis, one of said sliders mounted adjacent each end of said bar, an opening in said slider through which said one of said retaining pins passes, said opening having a retaining edge which is urged axially outwardly of said bar in a locking direction toward said notch by a slider spring, whereby movement of said slider opposite to said locking direction withdraws said edge from said notch and permits said rod to move to said open position and movement of said rod to said closed position permits said edge to enter said notch and hold said rod in said closed position.

3. The device of claim 1 further comprising a resilient layer on said rod between said rod and said bar.

4. The device of claim 1 wherein there are two said retaining pins, one said notch on each retaining pin, one said pressure member on each said retaining pin, and one said slider for each said retaining pin.

5. The device of claim 1 wherein said slider is adjacent one end of said bar.

6. The device of claim 1 wherein there are two said retaining pins and two said sliders.

7. The device of claim 6 wherein there in one said slider adjacent each end of said bar.

8. The device of claim 1 wherein said open position is remote from said bar and said closed position is adjacent said bar.

9. The device of claim 7 wherein said retaining edge is urged axially inwardly of said bar, said open position is remote from said bar, and said closed position is adjacent said bar.

10. The device of claim 1 wherein said pressure member is a separating spring.

11. The device of claim 10 wherein said separating spring is a compression spring.

12. The device of claim 2 wherein said retaining edge is urged in said locking direction by a slider spring.

13. The device of claim 2 wherein said slider spring is a compression spring.

14. The device claim 1 wherein slider guides are provided adjacent said slider.

15. The device of claim 1 wherein said slider spring is a coil spring and said spring guide is mounted on said bar and slidably mounted on said spring guide.

16.The device of claim 1 comprising a spring guide located within said slider spring and parallel to said axis.

17. The device of claim 2 further comprising a resilient layer on said rod between said rod and said bar.

18. The device of claim 2 wherein there is one said pressure member on each said retaining pin.

19. The device of claim 2 wherein said pressure member is a separating spring.

20. The device of claim 10 wherein said separating spring is a compression spring.

* * * * *